US006901753B1

(12) United States Patent
Puzey

(10) Patent No.: US 6,901,753 B1
(45) Date of Patent: Jun. 7, 2005

(54) ENGINE EXPANSION PIPE

(76) Inventor: Michael Roydon Puzey, P.O. Box 1039, Ferndale (ZA) 2160

( * ) Notice: Subject to any disclaimer, the term of this patent is extended or adjusted under 35 U.S.C. 154(b) by 0 days.

(21) Appl. No.: 10/765,188

(22) Filed: Jan. 28, 2004

(51) Int. Cl.[7] ..... F01N 7/00
(52) U.S. Cl. ..... 60/322; 60/312
(58) Field of Search ..... 60/282, 312, 322, 60/324

(56) References Cited

U.S. PATENT DOCUMENTS 5,016,439 A * 5/1991 Nitta ..... 60/310
5,562,509 A * 10/1996 Nakase et al. ..... 440/89 R
5,953,909 A * 9/1999 Waltrip, III ..... 60/275

* cited by examiner

*Primary Examiner*—Thomas Denion
*Assistant Examiner*—Diem Tran
(74) *Attorney, Agent, or Firm*—Bacon & Thomas, PLLC

(57) ABSTRACT

An expansion pipe for an engine which has a curved tubular body, a first connector for connecting an interior of the body to an exhaust part of the engine, and a second connector which is used for connecting an interior of the body to an exhaust gas treatment device and which has the same configuration as the first connector.

5 Claims, 5 Drawing Sheets

ENGINE EXPANSION PIPE

BACKGROUND OF THE INVENTION

This invention relates to an expansion pipe for use with an engine.

In a number of countries small two stroke or four stroke gasoline (petrol) engines are subject to strict exhaust gas emission control standards, a requirement which is generally met by the original manufacturer fitting catalytic converters to the engines.

If this type of engine is used to power a small vehicle such as a scooter or cart then it is quite common for a user, or vehicle manufacturer, to attempt to increase the power output of the engine by adding a performance enhancing system to the engine. Typically use is made of an expansion pipe which is connected to an exhaust port of the engine. When this is done however it is no longer possible for the modified engine to meet exhaust gas emission requirements.

The invention is concerned with a performance enhancing system which can be used with an engine to which a catalytic converter or similar device is fitted, without affecting the exhaust gas emission rating of the engine.

SUMMARY OF INVENTION

The invention provides an expansion pipe for use with an engine which includes an elongate, curved tubular body which has a first open end and a second closed end, a first connecting component secured to the first open end for attaching the body to an exhaust gas port of the engine, and a second connecting component, which defines an outlet from the interior of the body and which is positioned between the first and second ends of the body, whereby a device, for treating exhaust gas leaving the body interior, is attachable to the body.

The expansion pipe may include a mounting member fixed to the body between the second connecting component and the first end of the body.

The body may be formed from at least a first section which includes the first end and a second section which is engaged with the first section, which includes the second end and which is detachable from the first section. The second section, when engaged with the first section, may be at least axially movable, to a limited extent, relatively to the first section.

The second section may be formed from a first body part with a first curved longitudinally extending axis which lies in a first plane and a second body part with a second curved longitudinally extending axis which lies in a second plane which is angularly displaced relatively to the first plane.

The tubular body may have a cross sectional area which increases in size over a region which extends from the second end to a location, between the first end and the second end, at which the cross sectional area has a maximum size, and the second connecting component may be located in the region.

The invention also extends to a combination of an engine with an exhaust port and an expansion pipe of the aforementioned kind, wherein the first connecting component is attached to the exhaust port and which includes an exhaust gas treatment device attached to the second connecting component.

The first connecting component may comprise a first flange with at least two mounting holes of a first size which are spaced apart by a first distance and the exhaust gas treatment device may include a mounting flange with at least two mounting holes of the first size which are spaced apart by the first distance.

BRIEF DESCRIPTION OF THE DRAWINGS

The invention is further described by way of example with reference to the accompanying drawings in which.

DESCRIPTION OF PREFERRED EMBODIMENT

Figure 1:
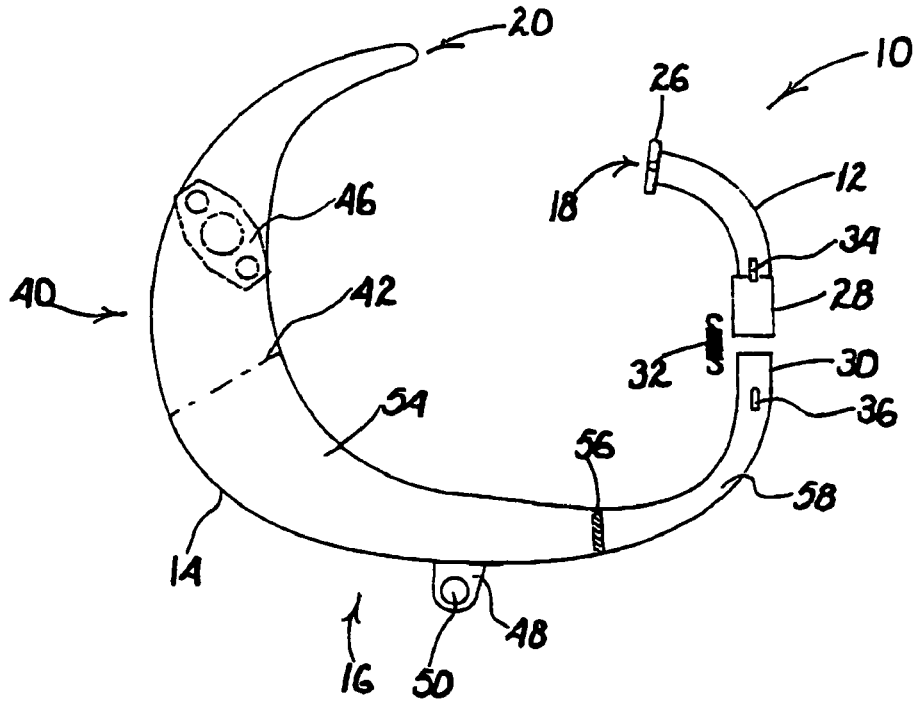
FIG. 1 is a side view of an expansion pipe according to the invention.
Figure 2:
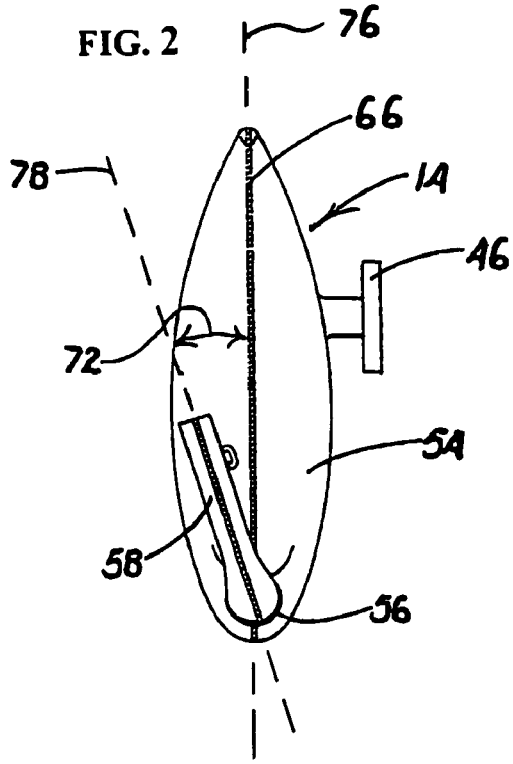
FIG. 2 is an end view, in the direction of an arrow marked 2 in FIG. 1, of a section of the expansion pipe.
Figure 3:
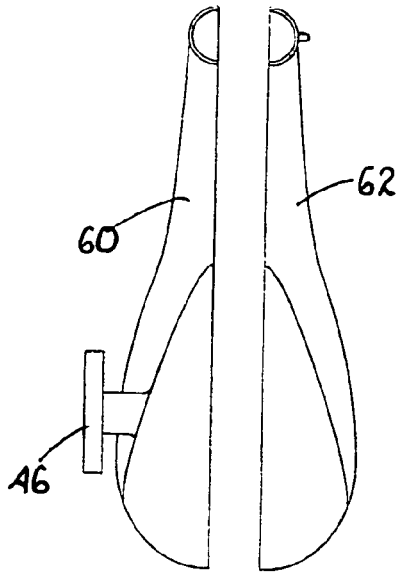
FIGS. 3, 4, 5 and 6 respectively illustrate different stages in the manufacture of the expansion pipe of FIG. 1.

FIGS. 1 and 2 of the accompanying drawings illustrate from the side and from one end respectively an expansion pipe 10 according to the invention which includes a relatively small first section 12 and a relatively large second section 14.

The sections 12 and 14, when engaged with each other in the manner which is described hereinafter, make up an elongate curved tubular body 16 which has a first open end 18 and a second closed end 20.

A first connecting component in the form of a first flange 26 is attached to the inlet 18. The section 12, at an end which is remote from the flange 26, is formed with a socket 28 into which a spigot 30, at an opposing end of the section 14, is insertable. A coil spring 32 is engageable with eyelet formations 34 and 36 respectively on the socket and spigot respectively.

The section 14 increases in cross sectional area from the second closed end 20 over a region 40 to a location 42 at which the cross sectional area of the tubular body is at a maximum. Thereafter the cross sectional area decreases in a direction moving towards the spigot 30.

A second connecting component in the form of a second flange 46 is attached to the second section 14 between the second end 20 and the location 42. A mounting member 48 in the form of a flange with a small hole 50 is fixed to the second section 14 between the location 42 and the spigot 30.

The second section 14 comprises a first relatively large body part 54 which extends between the second end and a weld 56, and a second relatively small body part 58 which extends between the weld 56 and the spigot 30.

FIGS. 3 to 6 illustrate successive stages in the manufacture of the section 14. Two shells 60 and 62 are formed in pressing operations using suitable tools. The second flange 46 is welded to the shell 60 at the location indicated in FIG. 1. A hole is formed through the wall of the shell so that the flange 46 is in communication with the interior of the tubular body 16 (when it is formed).

Figure 4:
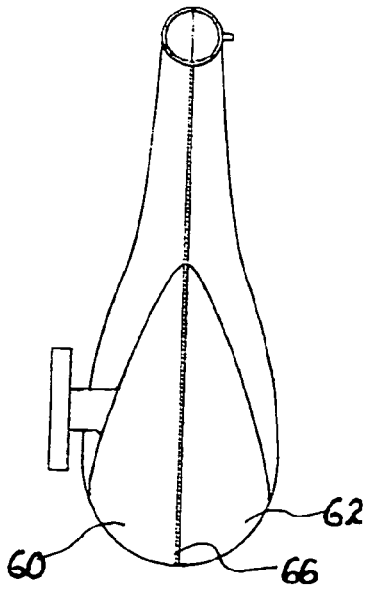
Figure 5:
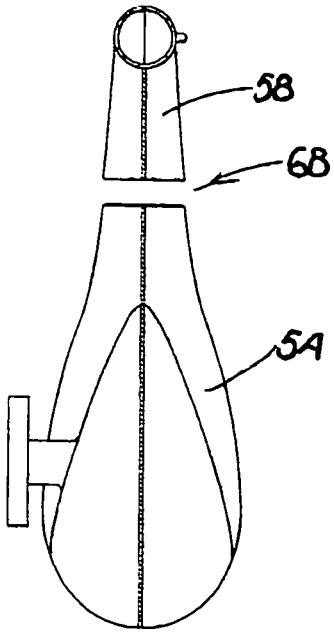
Figure 6:
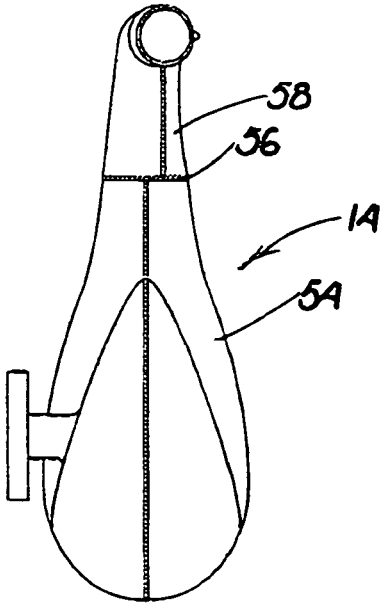

As is shown in FIG. 4 the two shells 60 and 62 are mated and they are welded together along a line 66 which extends over the full peripheries of the shells and which lies in one plane. The resulting structure is then severed along a line 68, see FIG. 5, to form the first body part 54 and the relatively small second body part 58. At the line 68 the tubular bore of the body is substantially circular. The part 58 is then angularly displaced by an angle 72, see FIG. 2, relatively to the part 54, whereafter the parts are reengaged with each other and are welded together along the weld line 56. In this way the first body part 54 is formed with a first curved longitudinally extending axis which lies in a first plane 76 (see FIG. 2) while the second body part 58 is formed with a curved longitudinally extending axis which lies in a second plane 78 which is displaced angularly relatively to the first plane.

Figure 7:
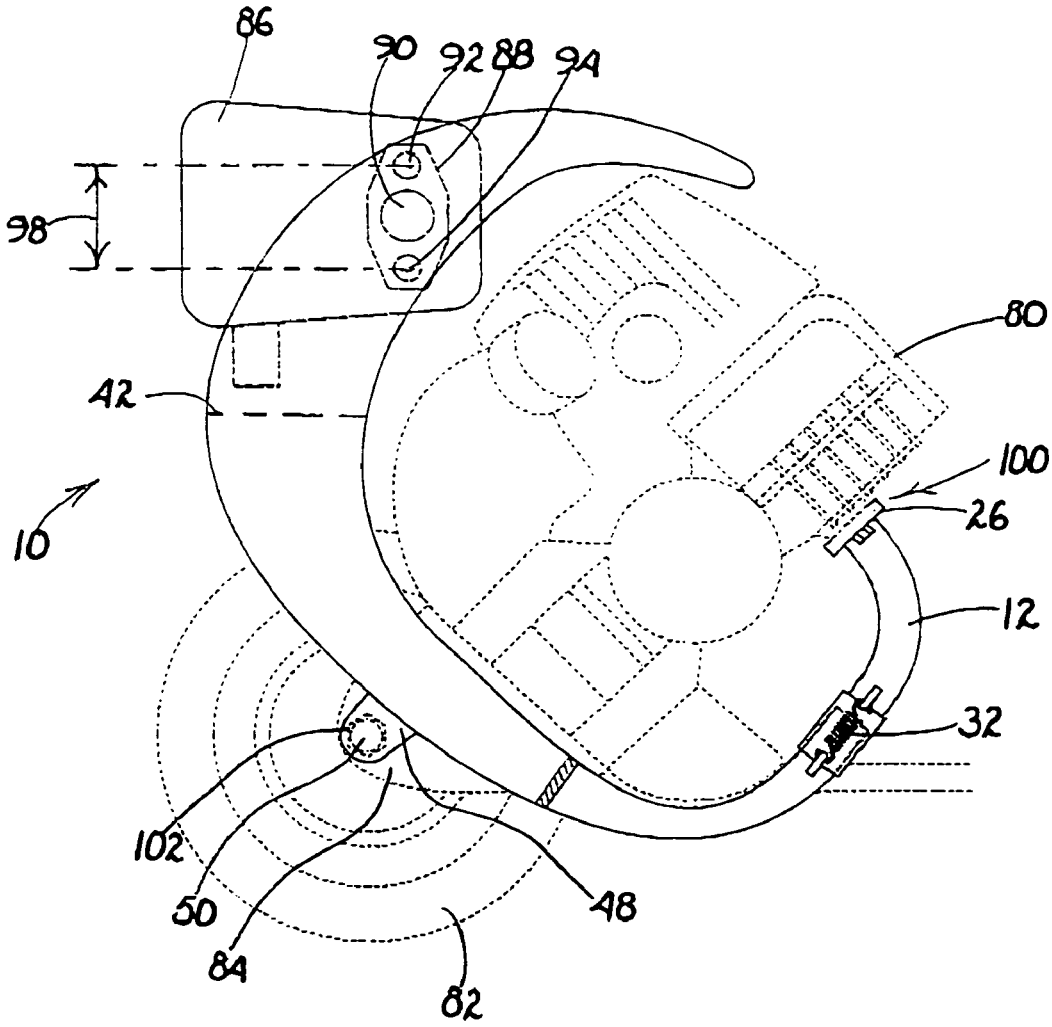
FIG. 7 is a side view of the expansion pipe of the invention fitted to an engine of a vehicle such as a scooter.
Figure 8:
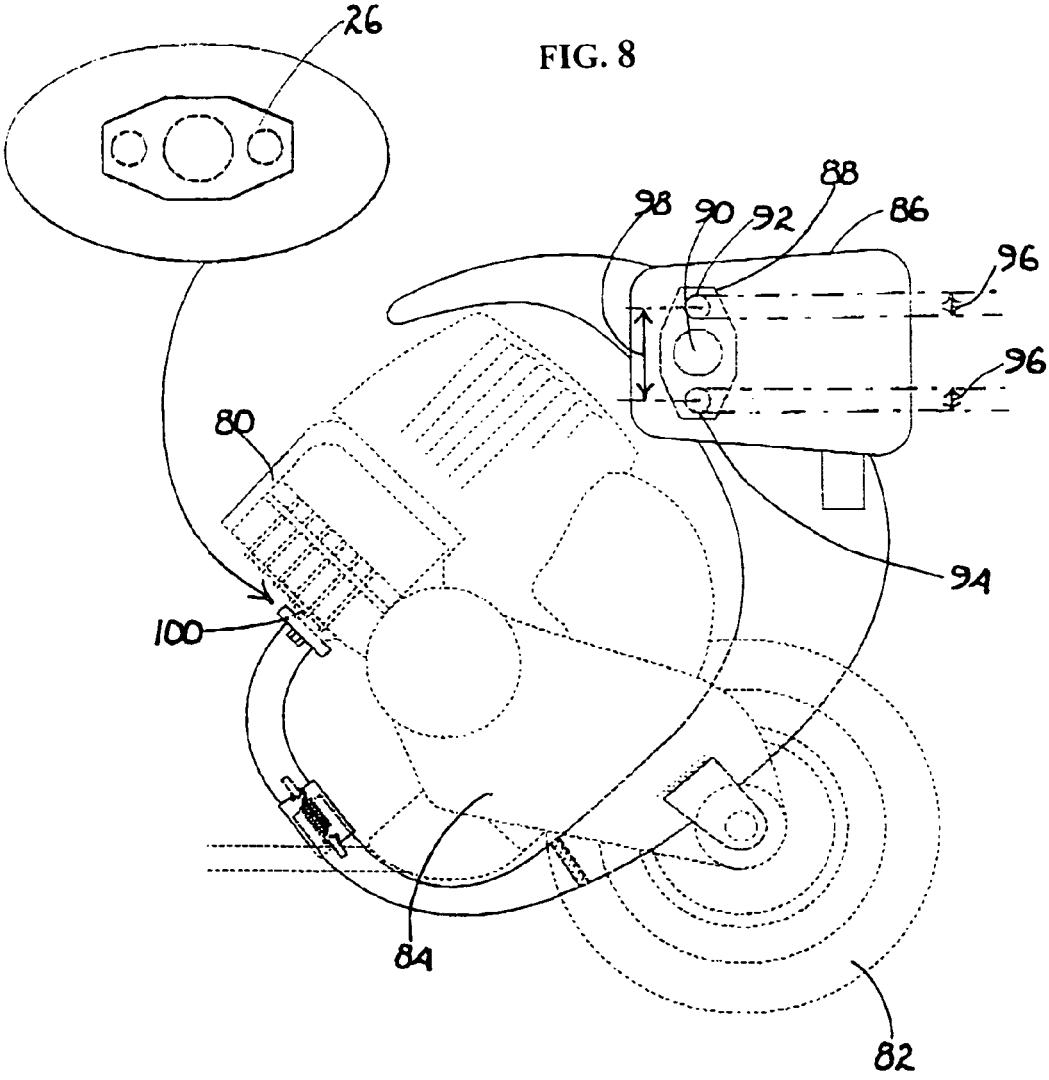
FIG. 8 is a view similar to that shown in FIG. 7 but from an opposing side of the vehicle.

FIGS. 7 and 8 illustrate the expansion pipe 10 attached to an engine 80 of a vehicle such as a scooter. The scooter is not shown in detail for the Figures only illustrate a driven wheel 82 which, in use, is driven by the engine 80 through a gearbox or drive arrangement 84. These aspects are substantially conventional and therefore are not further described herein.

The engine 80 is supplied with a catalytic converter or similar device 86 for treating exhaust gasses emitted by the engine in order to comply with exhaust gas emission requirements. The device 86, which may be of conventional construction, has a mounting flange 88 which includes a central opening 90 and two holes 92 and 94 respectively on opposed sides of the opening 90. The mounting flange 88 is for all practical purposes the same as the second flange 46 shown for example in FIG. 1. The holes 92 and 94 have the same diameter 96 and are spaced apart by a distance 98.

The engine 80 has an exhaust port 100 to which the device 86 is normally attached. Thus the mounting configuration on the exhaust port for the device 86, is essentially the same as the configuration described for the mounting flange 88.

The first flange 26 on the first section 12 also has substantially the same configuration as the mounting flange 88 and is shown in the inset drawing in FIG. 8.

The engine 80, in the condition in which it is supplied by a manufacturer, has the device 86 directly bolted to the exhaust port 100. The expansion pipe 10 has substantial length and is significantly heavier than the device 86. Although the flange 26 is directly bolted to the exhaust port, as is shown in FIGS. 7 and 8, a significant moment is created by the mass and size of the pipe which, coupled with vibratory forces which are set up when the vehicle travels, would rapidly cause the joint between the expansion pipe and the exhaust port to fail. The curved construction of the expansion pipe is designed to limit the moment. Also the angular offset 72 between the first body part 54 and the second body part 58 is intended to bring a portion of the mass of the expansion pipe to bear over the engine and not on one side thereof. The mounting member 48 is configured so that the hole 50 is directly engageable with an axle 102 which supports the wheel 82. To reduce the magnitude of the vibratory forces imparted by the engine to the expansion pipe, the socket 28 and spigot 30 are not permanently fixed to one another but are rotatable, in an angular sense, relatively to each other to a limited extent and are movable apart, against the biasing action of the spring 32, in an axial sense, again to a limited extent.

It has been found that the expansion pipe 10 significantly increases the power output of the engine 80. Through experimentation it has been found that the device 86, when positioned in the region 40 between the end 20 and the location 42, does not materially reduce the power increase which is obtained through the use of the expansion pipe. On the other hand the device 86 functions in the conventional manner and ensures that the exhaust gas emitted by the engine 80 meets statutory emission requirements. A further unexpected benefit of the expansion pipe, when used in the illustrated manner, is that the noise level of the exhaust system with the expansion pipe is significantly less than the noise level of the engine without the expansion pipe ie. when the device 86 is directly bolted to the engine. The reason for this is not fully understood.

What is claimed is:

1. An expansion pipe for use with an engine, which includes:

an elongate, curved tubular body formed from a first tubular section with open first and second ends, and a second section which has an open end and a closed end, the cross sectional area of the second section increasing from the closed end to a maximum area at a location which is between the open end and the closed end and then decreasing from the location towards the open end; and a first connecting component secured to the first end of the first section for attaching the elongate curved tubular body to an exhaust gas port of the engine, the second end of the first section and the open end of the second section being detachably engaged with each other and being axially rotatable, to a limited extent, relatively to each other, the elongate curved tubular body defining a first body part with a first curved longitudinally extending axis which lies in a first plane and a second body part with a second curved longitudinally extending axis which lies in a second plane which is displaced angularly relatively to the first plane; and a second connecting component, which defines an outlet from an interior of the elongate curved tubular body and which is positioned between the first end of the first section and the closed end of the second section, whereby a device, for treating exhaust gas leaving the body interior, is attachable to the elongate curved tubular body.

2. The expansion pipe according to claim 1, which further includes:

a mounting member fixed to the elongate curved tubular body, between the second connecting component and the first end of the first section.

3. The expansion pipe according to claim 1, wherein the second section, when engaged with the first section, is at least axially movable, to a limited extent, relatively to the first section.

4. In combination, an engine with an exhaust port, an expansion pipe according to claim 1, wherein the first connecting component is attached to the exhaust port, and an exhaust gas treatment device attached to the second connecting component.

5. The combination according to claim 4, wherein the first connecting component comprises a first flange with at least two mounting holes of a first size which are spaced apart by a first distance, and the exhaust gas treatment device includes a mounting flange with at least two mounting holes of the first size which are spaced apart by the first distance.

* * * * *